US006253771B1

(12) United States Patent
McClaine

(10) Patent No.: US 6,253,771 B1
(45) Date of Patent: Jul. 3, 2001

(54) HAIR THINNING MEASUREMENT DEVICE

(75) Inventor: Elayne P. McClaine, Basking Ridge, NJ (US)

(73) Assignee: Pharmacia Corporation, Peapack, NJ (US)

( * ) Notice: Subject to any disclaimer, the term of this patent is extended or adjusted under 35 U.S.C. 154(b) by 0 days.

(21) Appl. No.: 09/660,828

(22) Filed: Sep. 13, 2000

(51) Int. Cl.[7] ..... A45D 24/34

(52) U.S. Cl. ..... 132/200; 132/148; 132/213.1; 33/485

(58) Field of Search ..... 132/148, 150, 132/161, 200, 213.1; 33/484, 485, 486, 487, 488

(56) References Cited

U.S. PATENT DOCUMENTS

| | | | | |
|---|---|---|---|---|
| 46,082 | * | 1/1865 | Colburn | 132/148 |
| D. 116,039 | * | 8/1939 | Madsen | 132/148 |
| 1,224,199 | * | 5/1917 | Munson | 132/148 |
| 2,245,469 | * | 6/1941 | Ecklund et al. | 132/148 |
| 2,275,077 | * | 3/1942 | Higgins | 132/161 |
| 3,181,540 | * | 5/1965 | Abraham | 132/161 |
| 4,502,498 | * | 3/1985 | Saferstein et al. | 132/148 |
| 4,768,531 | * | 9/1988 | Broussard | 132/148 |
| 5,033,200 | * | 7/1991 | Leung | 33/485 |

FOREIGN PATENT DOCUMENTS

| | | | | |
|---|---|---|---|---|
| 823329 | * | 7/1949 | (DE) | 132/150 |

* cited by examiner

*Primary Examiner*—Todd E. Manahan
(74) *Attorney, Agent, or Firm*—Craig M. Bell

(57) ABSTRACT

A comb-like device is useful in the measurement of hair thickness and density in order to determine the extent and/or degree of hair loss or thinning as well as hair regeneration if undergoing treatment therefore. The comb section or teeth are modified into a plurality of different sized tines for measuring hair depth and thickness while the handle is tapered and calibrated for measuring any increase or decrease in the size of the individual's part. The handle is further modified through the incorporation of a magnifying glass for visual inspection of the individual's hair and scalp. The device is primarily designed for women.

5 Claims, 2 Drawing Sheets

HAIR THINNING MEASUREMENT DEVICE

FIELD OF THE INVENTION

The present invention relates generally to methods and devices for treating hair loss and thinning. More specifically, the present invention relates to methods and means for determining the amount and/or rate of hair loss in a given female individual.

BACKGROUND OF THE INVENTION

Hair loss is a problem which many men and women experience in their lifetime. The most common cause of hair loss is associated with the normal aging process. The process of losing one's hair is most often gradual. It is often first noticed during washing or grooming. This observation is imprecise in predicting permanent hair loss, as most individual hair follicles go into a dormant period (20% of the hair population at any one time) and a reduction of hair population may be partly the result of this process although this process is usually uniform.

The distinguishing factor which differentiates permanent hair loss from cyclical hair loss is that the population of the hair decreases gradually in affected areas resulting in a permanent loss of hair and a reduction of hair population and hair density. The permanent loss of hair is often selective by anatomical site. In men, hair loss follows one pattern ("Male Pattern Baldness" or "Androgenic Alopecia") and in women it follows another pattern. The process of losing hair also occurs at different rates, for different periods of time and at different ages, even in the same individual.

Dermatologists recognize many different types of hair loss, the most common by far being "androgenic alopecia" wherein human males begin losing scalp hair at the temples and on the crown of the head in early adult life. This type of hair loss is more common and more severe in males, hence its common name "male pattern baldness." However, similar patterned baldness occurs in women, though it progresses more slowly and does not reach the end stage of complete denudation. An effective treatment for these and related conditions has long been sought.

Many women think thinning hair is abnormal or unnatural, i.e., a man's problem. Some believe that if their hair is thinning, then they must be sick, or that it's stress related. Among women younger than 50 who experience hair thinning, most assume that it is caused by something external, while women over 50 normally attribute it to just another part of aging. Temporary conditions such as pregnancy, medication, diet, or stress can cause hair thinning. However, for 70% of the women who experience the condition, it can be attributed to androgenetic alopecia.

Both women and men experience androgenetic alopecia and approximately 50 million men have hereditary hair thinning compared to nearly 30 million women. However, it affects the genders differently. While men experience "pattern baldness", vertex balding and/or receding frontal hairline, women generally experience diffused thinning over the top of the head or crown, while most often maintaining a frontal hairline. Androgenetic alopecia is non-discriminating, affecting men and women of all races and ethnicities, and is passed down by one's parents.

Surprisingly, it is not something that happens to women only after menopause. It can begin as early as the 20s and is so common, that by age 35, almost 40% of women demonstrate some signs of hair thinning. By the age of 50, approximately 50% of women will experience some degree of hair thinning.

As one ages, a combination of heredity, the effects of hormones and age causes certain hair follicles to get smaller and smaller. This prevents the hair from fulfilling its regular growth process, which is usually ½ inch per month. With androgenetic alopecia, genetically predisposed follicles gradually become smaller and the period of time in which the hair grows is reduced—a process known as miniaturization. And hair that can only grow for a short time is shorter, thinner, even colorless.

There are two types of hair follicles which produce either "terminal hairs" or "vellus hairs." Terminal hairs are coarse, pigmented, long hairs in which the bulb of the follicle is situated deep in the skin, usually in the subcutaneous tissue. Vellus hairs, on the other hand, are fine, thin, non-pigmented short hairs whose bulbs are located superficially in the upper dermis. In patterned alopecia, follicles which produce terminal hairs are gradually converted to vellus ones through a miniaturization process.

Along with this progressive involution there inevitably occurs changes in the proportion of hairs in the various phases of the hair cycle. All follicles pass through a life cycle that includes three phases namely, (1) anagen (2) catagen and (3) telogen. The anagen phase is the period of active hair growth and on the scalp generally lasts from 3–6 years. Catagen is a short transitional phase when the follicle contracts in preparation for a resting period. It lasts a couple of weeks. In telogen, the follicle is in a resting phase where all growth ceases and the hair becomes consisted of short "club" hairs. When a new cycle begins, the club hair is shed. Telogen scalp hairs are relative short-lived, and last only about three to four months.

Normally, approximately 90% of scalp hairs are in the anagen phase, less than 1% exist in the catagen phase and the remainder are in the telogen phase. With the onset of patterned baldness, a successively greater proportion of hairs are in the telogen phase, with correspondingly fewer in the active growth anagen phase.

Additionally, there may be some actual loss of hair follicles but this is limited to the last final phase. For the most part, the visible diminution in the bulk of hair is due to the miniaturization of the follicles. In completely bald areas, all the follicles are in the vellus phase producing ugly, fine, short, non-pigmented hairs which are cosmetically useless. It may take 20 to 30 years for the distinctly anagen follicles on the crown to become transformed into a uniform population of vellus follicles.

Patterned baldness is sometimes called androgenic alopecia because male hormones are necessary for its development. It does not occur before adolescence, nor in castrates. Attempts to prevent alopecia by hormonal treatments by using anti-androgens or female hormones have failed. A hereditary component is also recognized since patterned alopecia runs in families. Despite intensive investigation, the mechanism whereby terminal follicles convert to vellus ones is unknown.

At the present time, one effective treatment for patterned alopecia is hair transplantation. Plugs of hair-bearing skin from the back of the scalp are transplanted into the bald areas. The procedure is costly and painful. Hundreds of plugs must be transplanted to create an appearance of hairiness and it is virtually impossible to obtain anything near the original density and thickness of terminal hair.

Many other approaches for creating or reversing patterned alopecia have been tried including ultra-violet radiation, massage, chemical irritation and innumerable natural products and herbs. However, none of these have been generally accepted as effective.

Pharmaceuticals offer a more rational approach although most tested have been found to be poorly metabolized and the results have been less than satisfactory. In Europe, a schedule of estrogens and anti-androgens have been administered orally to balding females with inconsistent results and with obvious limitations.

The topical application of minoxidil is currently the most effective therapy for patterned alopecia. Minoxidil is a well-known pharmaceutical agent marketed by the Upjohn Company (Kalamazoo, Mich.) and administered in tablet form for the treatment of hypertension. Numerous investigators have demonstrated that it can also stimulate visible hair growth in a majority of balding subjects. The structure and use of this compound is described in U.S. Pat. Nos. 4,139,619 an 4,596,812 to Chidsey et al. This compound has varying degrees of efficacy for moderating androgenic alopecia, depending on the degree of baldness, its duration, the age of the patient and, of course, on the concentration of the drug in an appropriate vehicle.

The ability to diagnose hair loss in its earliest stages is difficult and compounded by many aesthetic factors which reflect the visual contrast between hair color and character against the color background of the scalp. In individuals with black course hair and white skin, the contrast is dramatic and hair loss is evident early in the process. In individuals with blond hair and blond skin, significant hair loss can occur before it is evident as the contrast between scalp and hair color is minimal.

In all cases, the diagnosis of hair loss is a subjective assessment made by either doctor or patient, and the response to treatment is often subjective as well. Heretofore, objective measurements of hair density has not been practical and as a result the effectiveness of snake oils of many varieties as well as medicines approved by the Federal Drug Administration go unproven for any selected individual.

It is an object of the present invention to provide a method and means for measuring the degree and rate of hair loss in a given individual, and in particular, in women. The device and method not only is useful in determining how much hair is lost, but, when used in conjunction with the therapies discussed above, how much hair may be regained through the stimulation of new growth and/or the rate at which such hair loss may be delayed and/or retarded.

SUMMARY OF THE INVENTION

The present invention comprises a comb-like device whose teeth and handle are modified to be allowed for the measurement of hair fullness, the width of any parting in the hair and the degree of regrowth. The handle is further modified with a magnifying glass for the inspection and analysis of new growth and the generation of vellus hairs. The device further allows for the ongoing monitoring of any such growth and/or loss.

DETAILED DESCRIPTION OF THE DRAWINGS

DETAILED DESCRIPTION OF THE INVENTION

U.S. Pat. No. 4,596,812, to Chidsey et al., discloses the use of minoxidil (6-amino-1,2-dihydro-1-hydroxy-2-imino-4-piperidinopyrimidine), as a therapeutic agent to treat alopecia and arrest and reverse male pattern alopecia. U.S. Pat. No. 4,139,619, also to Chidsey, discloses the use of minoxidil and related 6-amino-4(substituted amino)-1,2-dihydro-1-hydroxy-2-imino-pyrimidines as a means for (a) increasing the rate of growth of terminal hair, and (b) converting vellus hair to grow as terminal hair. U.S. Pat. No. 5,026,691 to Klegman discloses and claims pharmaceutical compositions comprising minoxidil in combination with anti-inflammatory agents for treating human baldness. The use of retinoids alone or in combination with minoxidil and related substituted pyrimidines to increase hair growth is disclosed in PCT publication numbers PCT/US85/04577, PCT/US83/02558 and PCT/US82/02833. The use of minoxidil sulfate (2,6,-diamino-4-piperidinyl)-1-(sulfooxy)-pyrimidinium hydroxide) as a therapeutic agent to stimulate hair growth is disclosed in PCT Application PCT/US86/00073 published Jul. 31, 1986. All of these patents and applications (when issued) are hereby incorporated by reference.

As can be seen by a brief review of the drawings, the hair loss measuring device is comb-like in structure. The device measures the mass of a 1" square section of hair to determine the level of hair density and the rate of progressive thinning of hair in females. The device is used to progressively monitor the thinning or thickening of the same patch of hair. The comb with graduated tines is used to measure the depth of hair and to track any change in the level of hair placed in the 1" section of the comb. The hair measuring device includes a magnifying feature in the center of the handle which is used to monitor new hair growth and any evidence of vellus hairs. The handle edge of the device also features a graduated scale or rule from 0 to 6 centimeters to measure and track the width of the female center part.

Figure 1:
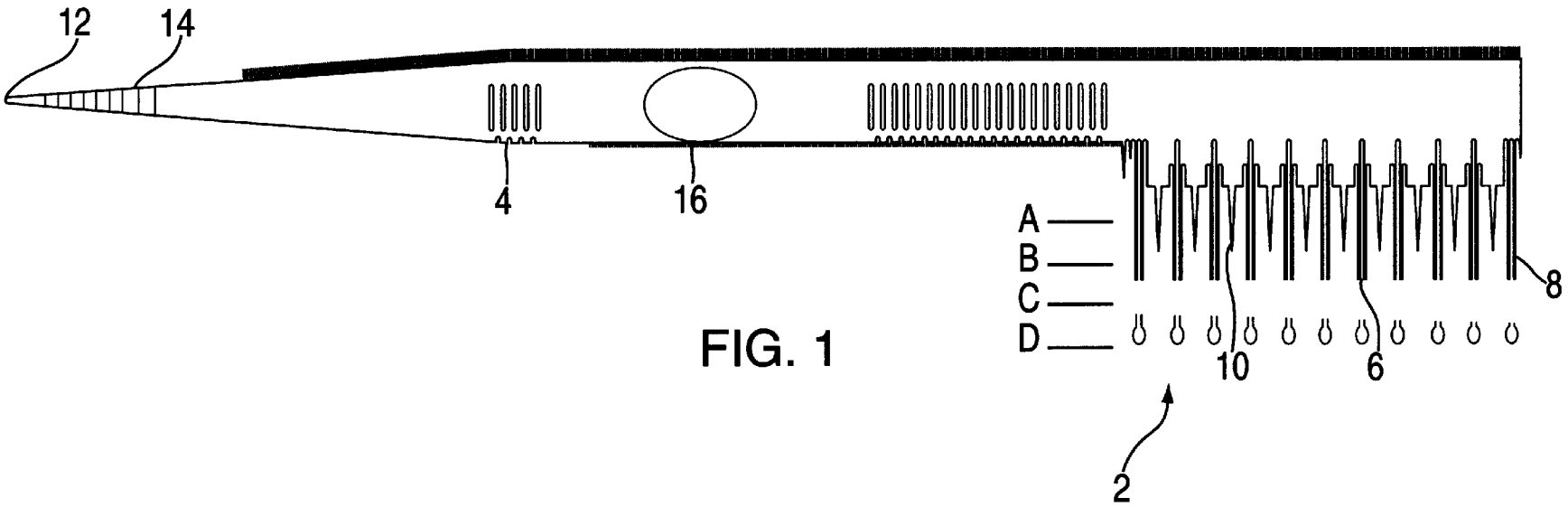
FIG. 1 is a lateral side view of a first embodiment of the present invention.

Referring now to FIG. 1, the hair measuring device (2) is comprised of a handle portion (4) and the measurement portion (6) comprised of multiple teeth or tines (8). The graduated tines (8) vary in size and when placed against the scalp determine the degree of hair loss or regrowth by the depth of the hair patch contacted. The tines will be graduated into four measuring heights as depicted in FIG. 1 by letters A, B, C and D. A tines will measure ¼ inch, B times ½ inch, C times ¾ inch and D times will measure 1 inch. The tines can be matched or colored to clearly indicate height. Between the tines are gaps or spaces (10) which determine the density of the hair being measured by the degree to which they are filled with hair. These spaces are about 1.0 mm each in width.

The handle of the hair loss/regrowth measuring device of the present invention is further modified to provide a graduated scale or rule to track or measure the female center part of the scalp. As seen in FIG. 1, the handle is tapered to a single pointed tip (12) that is conical in shape and calibrated about its circumference as a scale (14). The scale (14) in the handle (4) is used to measure the width of a part in the hair by placing the device vertically against the scalp with the tip inserted downwardly into the part. The scale is graduated about the handle's circumference from 0 to 6.0 cms. The edges of the two sides of the part are then lined up with the corresponding calibrations of the scale (14) on the handle (4) that would fill width of the part. Expansion of the width of the part is indicative of hair loss while a narrowing thereof indicates hair regrowth and rejuvenation.

The tapered handle (4) should contain 2.0.–3.0 inches of calibration and one side may calibrated in black on a white background for dark haired women and the other white on a black background for light haired women. The embodiment of the hair loss/regrowth measuring device (2) shown in FIG. 1, further includes a small magnifying glass (16) more centrally located in the handle (4). This allows for the inspection, qualification and quantification of the tiny vellus hairs which become prevalent in patterned alopecia. The reduction in the number and amount of these hairs and the consequent increase in the number and amount of the terminal hairs can be indicative of hair degeneration and regrowth while the reverse situation will be indicative of hair loss.

The thickness of the hair essentially is determined by combing a 1.0 inch swatch thereof with a portion comprising the various sized A, B, C and D tines. The amount of hair rejuvenation or hair loss can be determined by what level tine is reached during the combing. One may also monitor and note the change in thickness over time by noting changes in the tyne levels reached. The hair measuring device can be comprised of either metal or plastic components.

Figure 2:
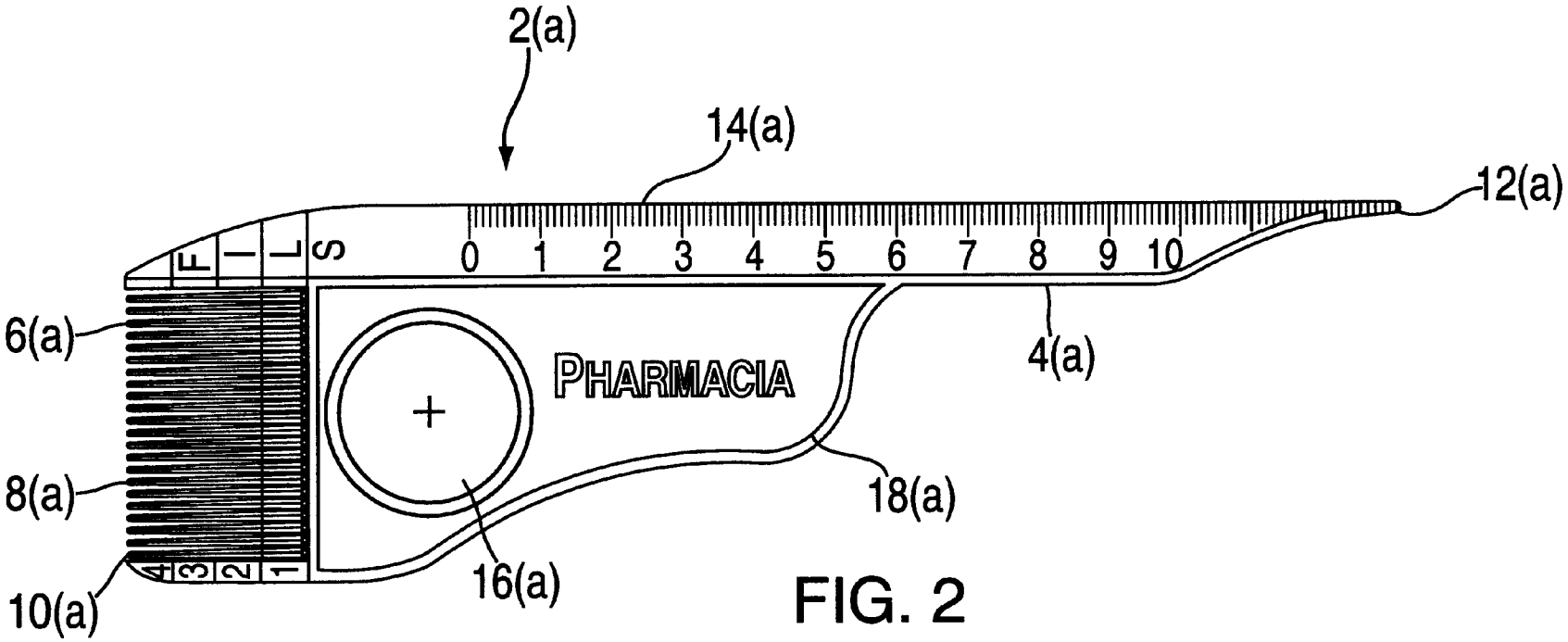
FIG. 2 is a lateral side view of a second embodiment of the present invention.

Referring now to FIG. 2, a second and preferred embodiment (2*a*) of the hair thinning detection device of the present invention is provided in which the same elements comprising the device depicted in FIG. 1 are re-arranged as a similar but, albeit different structure. Here the tines (8*a*) are situated perpendicular to the axis of the handle (4*a*) rather than aligned parallel thereto. The size of the magnifying glass (16*a*) is also expanded and is contained within a widened area or appendage (18*a*) of the handle (4*a*). The device functions in the same manner as that depicted in FIG. 1 and has proven useful by both dermatologists and hair styling professionals in the detection and prevention of hair loss and recession.

What I claim is:

1. A measuring device for determining the amount of hair loss or regeneration in a human comprising:

a) a tapered handle portion with calibrated indicia at the distal end thereof to measure the change in the width of the part in a human scalp, and;

b) a comb portion attached to the proximal end of said handle portion comprising a plurality of graded or graduated tines to measure the thickness and density of the humans viable hair.

2. The measuring device of claim 1 wherein said calibrated indicia corresponds to the width of a persons part in his or her scalp.

3. The measuring device of claim 2, wherein said tines are of at least four different lengths and are equidistantly spread along the length of said comb portion.

4. The measuring device of claim 3, wherein said tapered handle portion further comprises a magnifying glass incorporated within said handle.

5. A method for gauging the extent and degree of hair loss in an individual using the measuring device of claim 1 comprising a) measuring the thickness and density of hair through the insertion of graduated tines therein;

b) measuring the width of the center part using a calibrated handle, and c) observing the extent of hair loss or re-growth using a magnifying glass incorporated within the body of said handle.

* * * * *